US007273341B2

(12) United States Patent
Yoshii et al.

(10) Patent No.: US 7,273,341 B2
(45) Date of Patent: Sep. 25, 2007

(54) TRACTOR WITH A FRONT LOADER AND A BACKHOE ATTACHABLE THERETO

(75) Inventors: Takashi Yoshii, Sakai (JP); Masashi Osuga, Nara-ken (JP); Hiroshi Shimada, Nara-ken (JP)

(73) Assignee: Kubota Corporation, Osaka (JP)

( * ) Notice: Subject to any disclaimer, the term of this patent is extended or adjusted under 35 U.S.C. 154(b) by 372 days.

(21) Appl. No.: 10/782,644

(22) Filed: Feb. 19, 2004

(65) Prior Publication Data

US 2004/0161325 A1 Aug. 19, 2004

Related U.S. Application Data

(63) Continuation of application No. 10/077,587, filed on Feb. 15, 2002, now Pat. No. 6,769,860.

(30) Foreign Application Priority Data

Nov. 29, 2001 (JP) ..... 2001-363944

(51) Int. Cl.
*B66F 9/00* (2006.01)

(52) U.S. Cl. ..... 414/686; 414/687

(58) Field of Classification Search ..... 414/686, 414/687; 172/272, 273, 274, 275; 280/791, 280/792, 756; 296/203.01; 37/410, 403; 180/312; 56/14.9

See application file for complete search history.

(56) References Cited

U.S. PATENT DOCUMENTS 2,567,736 A 9/1951 Silver et al.
2,752,837 A 7/1956 Parker
4,056,250 A 11/1977 Uchiyama
4,087,009 A 5/1978 Profenna et al.
4,661,036 A 4/1987 Horsch
4,817,728 A 4/1989 Schmid et al.
5,000,269 A 3/1991 Aoki et al.
5,123,805 A 6/1992 Ishimori et al.
5,248,237 A 9/1993 Nakamura
6,056,502 A 5/2000 Takemura et al.
6,102,131 A 8/2000 Malinowski
6,446,367 B1 9/2002 Muramoto et al.

FOREIGN PATENT DOCUMENTS

JP 2001-173006 6/2001

*Primary Examiner*—David H. Bollinger
*Assistant Examiner*—M. S. Lowe
(74) *Attorney, Agent, or Firm*—The Webb Law Firm

(57) ABSTRACT

A tractor has a vehicle frame with a pair of right and left elongate frame members spaced from each other and extending in a longitudinal direction and interconnected in intermediate positions by a cross member, an engine supported by the elongate frame members in a front region of the vehicle frame, a rear axle unit connected to rear axle connecting members fixed to the elongate frame members in a rear region of the vehicle frame, and a drive transmitting mechanism for transmitting drive from the engine to the rear axle unit. A front loader and/or a backhoe are/is attachable to a front and a rear of the tractor as supported by the vehicle frame. A reinforcing frame unit is provided for reinforcing the vehicle frame. The reinforcing frame unit is connected to the vehicle frame by reinforcing frame connecting members spaced horizontally and/or vertically from the rear axle connecting members.

3 Claims, 10 Drawing Sheets

TRACTOR WITH A FRONT LOADER AND A BACKHOE ATTACHABLE THERETO

CROSS-REFERENCE TO RELATED APPLICATIONS

This application is a continuation of U.S. patent application Ser. No. 10/077,587, filed Feb. 15, 2002 now U.S. Pat. No. 6,769,860, which is hereby incorporated by reference in its entirety.

BACKGROUND OF THE INVENTION

1. Field of the Invention

This invention relates to a tractor having a vehicle frame with a pair of right and left elongate frame members spaced from each other and extending in a longitudinal direction and interconnected in intermediate positions by a cross member, an engine supported by the elongate frame members in a front region of the vehicle frame, a rear axle unit connected to rear axle connecting members fixed to the elongate frame members in a rear region of the vehicle frame, and a drive transmitting mechanism for transmitting drive from the engine to the rear axle unit, a front loader and/or a backhoe being attachable to a front and a rear of the tractor as supported by the vehicle frame.

2. Description of the Related Art

A tractor with a front loader and a backhoe attachable thereto as noted above, i.e. a so-called tractor-front loader-backhoe (TLB), is subjected to overloads such as compressive, tensile, twisting and bending forces acting on a vehicle frame when running with the backhoe attached to the rear end or during an excavating operation with the backhoe. Thus, the tractor must have a highly strong chassis to withstand such heavy loads. TLBs with such strong chassis are known from U.S. Pat. Nos. 4,087,009 and 4,661,036, for example.

Further, it is common practice to connect a reinforcing frame unit to a rear region of a vehicle frame to which a backhoe is attached, whereby the entire vehicle frame becomes strong enough to withstand overloads occurring when running with the backhoe attached to the rear end or during an excavating operation with the backhoe. Tractors with such reinforcing frames are known from U.S. Pat. Nos. 5,000,269 and 5,248,237, for example. U.S. Pat. No. 6,056,502 discloses a technique of connecting a front end of a reinforcing frame to a forward region of a vehicle frame by a flexible structure.

In any case, in connecting a reinforcing frame unit to a rear region of a vehicle frame, according to conventional practice, reinforcing frame connections are formed on the vehicle frame adjacent connections of a rear axle unit fixed to the vehicle frame.

That is, in the prior art noted above, a structure elastically deformable relatively freely is not provided between the rear axle connections and the reinforcing frame connections that are formed adjacent each other on the vehicle frame. Consequently, overloads occurring when running with a backhoe attached to the rear end or during an excavating operation with the backhoe are transmitted straight to the axle unit. It is therefore necessary for the casing of the rear axle unit also to have sufficient strength to withstand such overloads. As a result, the rear axle unit tends to be large and expensive to manufacture. It is difficult to attach a backhoe to a small tractor, in particular, for which lightweight and low cost are desired features.

SUMMARY OF THE INVENTION

The object of this invention is to suppress transmission to a rear axle unit of overloads occurring when running with a backhoe attached to the rear end or during an excavating operation with the backhoe, thereby to avoid an enlargement and increased manufacturing cost of the real axle unit due to reinforcement, for example, of the casing of the rear axle unit.

The above object is fulfilled, according to this invention, by a tractor having a vehicle frame with a pair of right and left elongate frame members spaced from each other and extending in a longitudinal direction and interconnected in intermediate positions by a cross member, an engine supported by the elongate frame members in a front region of the vehicle frame, a rear axle unit connected to rear axle connecting members fixed to the elongate frame members in a rear region of the vehicle frame, and a drive transmitting mechanism for transmitting drive from the engine to the rear axle unit, a front loader and/or a backhoe being attachable to a front and a rear of the tractor as supported by the vehicle frame, the tractor comprising a reinforcing frame unit for reinforcing the vehicle frame, and reinforcing frame connecting members for connecting the reinforcing frame unit to the vehicle frame, wherein the reinforcing frame connecting members are spaced horizontally and/or vertically from the rear axle connecting members.

With this construction, the reinforcing frame unit connected to the vehicle frame gives the latter increased strength for withstanding overloads such as compressive, tensile, twisting and bending forces occurring when the tractor runs with the backhoe attached or during an excavating operation with the backhoe. Further, the vehicle frame has the reinforcing frame connecting members and rear axle connecting members spaced from each other as noted above. The frame portions in between act as flexible structure portions relatively freely and elastically deformable when the tractor runs with the backhoe attached or during an excavating operation with the backhoe. The elastic deformation of these frame portions absorbs overloads occurring when the tractor runs or during an excavating operation, thereby suppressing transmission of the overloads to the rear axle unit. This invention effectively avoids an enlargement and increased manufacturing cost of the rear axle unit due to reinforcements of a casing and the like of the rear axle unit, and allows attachment of a backhoe to a small tractor for which lightweight and low cost are desired.

In a preferred embodiment of this invention, the reinforcing frame unit is in form of a gate-shaped frame including a pair of right and left side members and a horizontal member interconnecting upper positions of the side members, and the reinforcing frame connecting members are formed in lower end regions of the side members and rear end regions of the elongate frame members, the side members further forming backhoe attaching members. With this construction, the rear end region of the vehicle frame has increased strength, and the backhoe may be attached to the rear end region having the increased strength, without a special, additional frame member for defining the backhoe attaching portions. A frame portion, between the rear axle connecting member and the reinforcing frame connecting member to which the reinforcing frame connecting member of one of the side members is connected, of each of the right and left frame members acts as a flexible structure portion relatively freely and elastically deformable. The elastic deformation of this frame portion absorbs the overloads occurring when the tractor runs with the backhoe attached or during an excavating operation with the backhoe, thereby suppressing transmission of the overloads to the rear axle unit Another preferred embodiment of this invention provides brace members each connected at one end thereof to one of the side members, and at the other end to a position of one of the elongate frame members vertically spaced from one of the rear axle connecting members. With this construction, the gate-shaped frame to which the backhoe is attached has increased supporting strength. Loads acting on the gate-shaped frame are distributed to the right and left elongate frame members and the right and left brace members. Further, a frame portion of each of the right and left elongate frame members between a connection to the brace member and the rear axle connecting member, as well as the frame portion of each elongate frame member between the rear axle connecting member and the reinforcing frame connecting member, acts as a flexible structure portion relatively freely and elastically deformable. The elastic deformation of the frame portions of the right and left elongate frame members between the rear axle connecting members and the reinforcing frame connecting members absorbs components distributed to the right and left elongate frame members of the overloads occurring when the tractor runs with the backhoe attached or during an excavating operation with the backhoe, thereby suppressing transmission of the overload components to the rear axle unit. The elastic deformation of the frame portions of the right and left elongate frame members between the connections to the brace members and the rear axle connecting members absorbs load components distributed to the right and left brace members, thereby suppressing transmission of the overload components to the rear axle unit.

In a further preferred embodiment of this invention, the reinforcing frame unit is in form of at least one cross frame interconnecting rear end regions of the elongate frame members. With this construction, the rear end region of the vehicle frame is reinforced by the cross frame interconnecting rear end regions of the right and left elongate frame members. Further, a rearward frame portion between the rear axle connecting member and a connection to the cross member of each of the right and left elongate frame members acts as a flexible structure portion relatively freely and elastically deformable. The elastic deformation of these frame portions absorbs the overloads occurring when the tractor runs with the backhoe attached or during an excavating operation with the backhoe, thereby suppressing transmission of the overloads to the rear axle unit.

In a further preferred embodiment of this invention, the reinforcing frame unit includes elongate reinforcing frames extending along outer faces of the elongate frame members, respectively, and one of the reinforcing frame connecting members is formed in a rear end region of each of the reinforcing frames and a rear end region of each of the elongate frame members, and the other of the reinforcing frame connecting members is formed in a forward end region of each of the reinforcing frames and a forward end region beyond an engine mounting portion of each of the elongate frame members. With this construction, the overloads occurring when the tractor runs with the backhoe attached or during an excavating operation with the backhoe are distributed to the right and left elongate frame members and right and left reinforcing frames. A frame portion between the rear axle connecting member and the reinforcing frame connecting member in the rear end region of each of the right and left elongate frame members, and a frame portion of each of the right and left reinforcing frames between the rear reinforcing frame connecting member connected to the reinforcing frame connecting member of the elongate frame member and the front reinforcing frame connecting member connected to the reinforcing frame connecting member of the elongate frame member, act as flexible structure portions relatively freely and elastically deformable. The elastic deformation of the frame portions between the rear axle connecting members and the reinforcing frame connecting members in the rear end regions of the right and left elongate frame members absorbs components distributed to the right and left elongate frame members of the overloads occurring when the tractor runs with the backhoe attached or during an excavating operation with the backhoe, thereby suppressing transmission of the overload components to the rear axle unit. The elastic deformation of the frame portions between the front and rear reinforcing frame connecting members of the right and left reinforcing frames absorbs load components distributed to the right and left reinforcing frames, thereby avoiding transmission thereof to the rear axle unit.

In a further preferred embodiment of this invention, the reinforcing frame unit includes elongate reinforcing frames extending along outer faces of the elongate frame members, respectively, the elongate frame members have front loader post support members projecting laterally outwardly of longitudinally intermediate portions thereof, and one of the reinforcing frame connecting members is formed in a rear end region of each of the reinforcing frames and a rear end region of each of the elongate frame members, and the other of the reinforcing frame connecting members is formed in a forward end region of each of the reinforcing frames and each of the front loader post support members. With this construction, the overloads occurring when the tractor runs with the backhoe attached or during an excavating operation with the backhoe are distributed to the right and left elongate frame members and right and left reinforcing frames. A frame portion between the rear axle connecting member and the reinforcing frame connecting member in the rear end region of each of the right and left elongate frame members, and a frame portion of each of the right and left reinforcing frames between the rear reinforcing frame connecting member connected to the rear reinforcing frame connecting member of one of the elongate frame member and the front reinforcing frame connecting member connected to one of the front loader post support members, act as flexible structure portions relatively freely and elastically deformable. The elastic deformation of the frame portions between the rear axle connecting members and the reinforcing frame connecting members in the rear end regions of the right and left elongate frame members absorbs components distributed to the light and left elongate frame members of the overloads occurring when the tractor runs with the backhoe attached or during an excavating operation with the backhoe, thereby suppressing transmission of the overload components to the rear axle unit. The elastic deformation of the frame portions between the front and rear reinforcing frame connecting members of the right and left reinforcing frames absorbs load components distributed to the right and left reinforcing frames and transmits the load components to the front loader post support members, thereby avoiding transmission thereof to the rear axle unit.

In a further preferred embodiment of this invention, the reinforcing frame unit includes reinforcing frames extending along outer faces of the elongate frame members, respectively, the reinforcing frame connecting members are formed in a rear end region of each of the reinforcing frames and a rear end region of each of the elongate frame members, and the reinforcing frames are connected to the rear axle unit in positions spaced from the rear axle connecting members. With this construction, the overloads occurring when the tractor runs with the backhoe attached or during an excavating operation with the backhoe are distributed to the right and left elongate frame members 4 and right and left reinforcing frames. A frame portion between the rear axle connecting member and the reinforcing frame connecting member of each of the right and left elongate frame members, and a frame portion between a connection to one of the rear axle cases and the rear reinforcing frame connecting member of each of the light and left reinforcing frames, act as flexible structure portions relatively freely and elastically deformable. The elastic deformation of the frame portions between the rear axle connecting members and the reinforcing frame connecting members of the right and left elongate frame members absorbs components distributed to the right and left elongate frame members of the overloads occurring when the tractor runs with the backhoe attached or during an excavating operation with the backhoe, thereby suppressing transmission of the overload components to the rear axle unit. The elastic deformation of the frame portions between the connections to the rear axle cases and the rear reinforcing frame connecting portions in the rear end regions of the right and left reinforcing frames, absorbs load components distributed to the right and left reinforcing frames, thereby suppressing transmission thereof to the rear axle unit.

Other features and advantages of this invention will be apparent from the following description of the embodiments to be taken with reference to the drawings.

DESCRIPTION OF THE PREFERRED EMBODIMENTS

Figure 1:
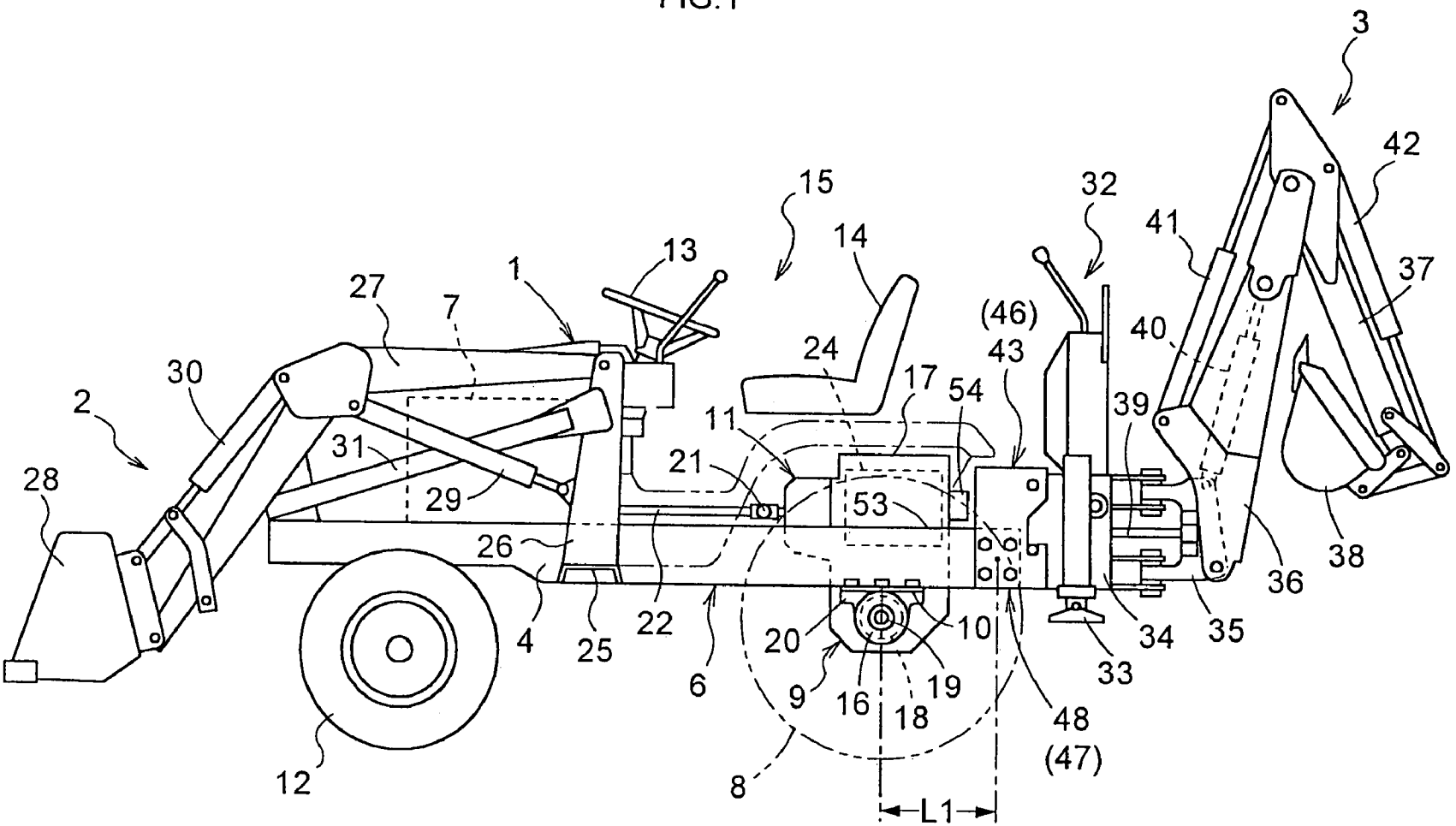
FIG. 1 is a side elevation of a tractor-front loader-backhoe.

FIG. 1 shows a side elevation of a tractor-front loader-backhoe (TLB) in which a tractor 1 has a front loader 2 attached to the front thereof and a backhoe 3 attached to the rear end.

Figure 2:
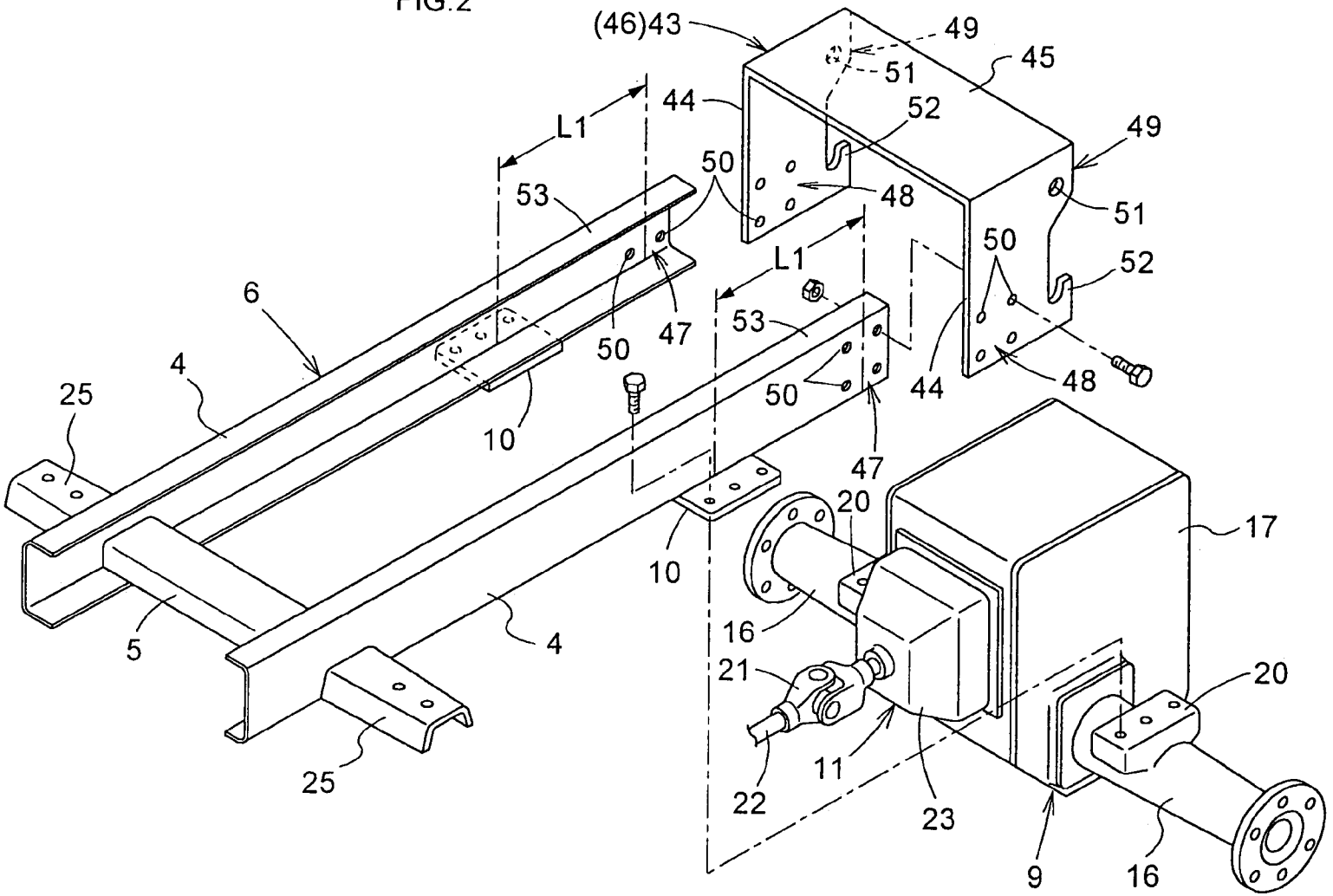
FIG. 2 is an exploded perspective view of a principal portion showing a reinforcing structure.
Figure 3:
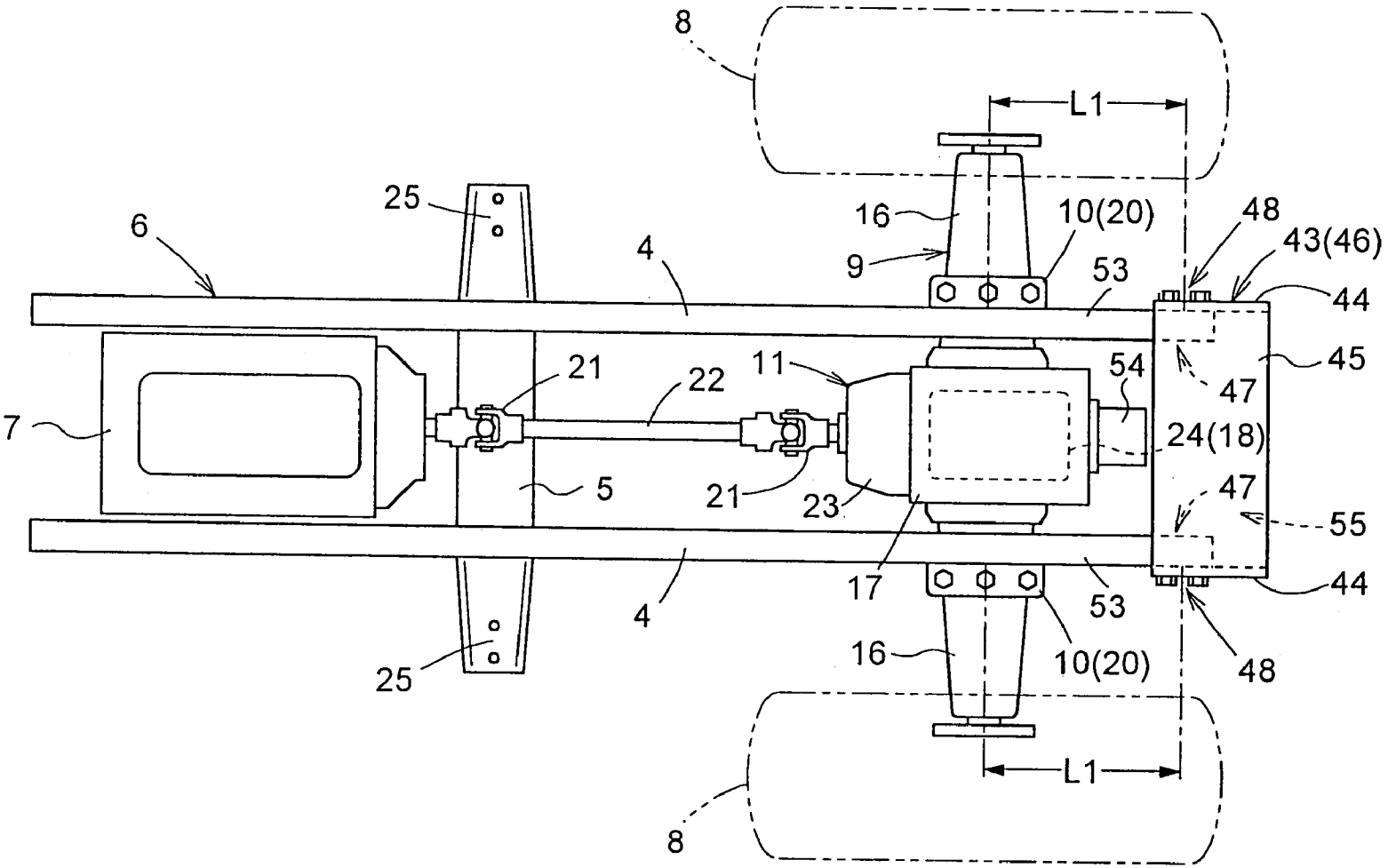
FIG. 3 is a plan view of the principal portion showing a reinforcing structure.

Referring to FIGS. 1 through 3, the tractor 1 includes a pair of right and left band-like elongate frame members 4 formed of sheet metal, extending longitudinally of a vehicle body and spaced from each other transversely of the vehicle body. The elongate frame members 4 are interconnected in intermediate positions thereof by a cross member 5 to form a vehicle frame 6. In a front region of the vehicle frame 6, an engine 7 is supported by the right and left elongate frame members 4 through rubber vibration isolators not shown. In a rear region of the vehicle frame 6, a rear axle unit 9 having a pair of right and left rear wheels 8 are attached is connected to connecting brackets 10 acting as rear axle connectors fixed to the right and left elongate frame members 4, respectively. The rear axle unit 9 has a drive transmission mechanism 11 secured thereto for changing the speed of drive from the engine 7 and transmitting the drive to the rear axle unit 9. A longitudinally intermediate region of the vehicle frame 6 between the engine 7 and drive transmission mechanism 11 provides a driving platform 15 including a steering wheel 13 for steering a pair of right and left front wheels 12, and a driver's seat 14.

The rear axle unit 9 includes a pair of right and left rear axle cases 16 connected to the connecting brackets 10, a rear differential 18 mounted in a lower portion of a transmission cases 17 connected to the light and left rear axle cases 16, and rear axles 19 extending right and left from the rear differential 18. Castings are employed as the right and left rear axle cases 16 and transmission case 17. The right and left rear axle cases 16 define connectors 20 in upper positions thereof for connection to the connecting bracket 10, respectively.

The drive transmission mechanism 11 includes an HST (hydrostatic stepless transmission) 23 connected to the front of transmission case 17 for receiving the drive from the engine 7 through front and rear universal joints 21 and a transmission shaft 22, and a gear type change speed device 24 mounted in an upper portion of transmission case 17 for receiving the drive having undergone speed changes by HST 23.

As shown in FIG. 1, the front loader 2 is detachably attached to the vehicle frame 6. The right and left elongate frame members 4 have front loader post support members 25 projecting laterally outwardly of longitudinally intermediate portions thereof, and a pair of right and left front loader posts 26 are erected on these support members 25, respectively. The front loader 2 includes a pair of right and left booms 27 vertically pivotably extending from upper ends of the respective front loader posts 26. A bucket 28 is vertically pivotably connected to, so as to bridge, distal ends of the booms 27. A pair of right and left boom cylinders 29 each extend between the corresponding front loader post 26 and boom 27. A bucket cylinder 30 extends between the booms 27 and bucket 28. A pair of right and left reinforcing brace members 31 each extend between the corresponding elongate frame member 4 and front loader post 26.

The backhoe 3 has been detachably constructed for vehicle frame 6. A base 34 includes a control unit 32 and outriggers 33. A swing bracket 35 is connected to the base 34 for swinging right and left. A boom 36 vertically pivotably extends from the swing bracket 35. An arm 37 extends from a distal end of the boom 36 to be pivotable back and forth. A bucket 38 is connected to a distal end of the arm 37 to be pivotable in an excavating operation. A swing cylinder 39 extends between the base 34 and swing bracket 35. A boom cylinder 40 extends between the swing bracket 35 and boom 36. An arm cylinder 41 extends between the boom 36 and arm 37. A bucket cylinder 42 extends between the arm 37 and bucket 38.

As shown in FIGS. 1 through 3, the vehicle frame 6 has a reinforcing frame unit 43 for reinforcing the vehicle frame 6. The reinforcing frame unit 43 is in the form of a gate-shaped frame 46 including a pair of right and left side members 44 made of sheet metal a horizontal member 45 made of sheet metal and interconnecting upper ends of the side members 44. Each elongate frame member 4 has a reinforcing frame connecting portion 47 formed in a rear end region thereof horizontally spaced by a distance L1 from the connecting bracket 10. Each side member 44 has a reinforcing frame connecting portion 48 formed in a lower end region thereof for connection to the reinforcing frame connecting portion 47. Further, each side member 44 has a backhoe attaching portion 49 formed in a rear end region thereof Each of the reinforcing frame connecting portions 47 and 48 of the elongate frame members 4 and reinforcing frame unit 43 includes four connecting bores 50. Each backhoe attaching portion 49 includes a connecting bore 51 and a hook 52.

That is, the reinforcing frame unit 43 interconnects the rear end regions of the right and left elongate frame members 4 of the vehicle frame 6. Thus, the rear end region of vehicle frame 6 to which the backhoe 3 is attached has increased strength for withstanding overloads such as compressive, tensile, twisting and bending forces occurring when the tractor runs with the backhoe 3 attached or during an excavating operation with the backhoe 3. The backhoe 3 may be attached to the rear end region having the increased strength, without a special, additional frame member for defining the backhoe attaching portions 49.

As noted above, each elongate frame member 4 provides the distance L1 between the connecting bracket 10 for connecting the rear axle unit 9 and the reinforcing frame connecting portion 47 for connecting the reinforcing frame unit 43. A frame portion 53 between the connecting bracket 10 and the reinforcing frame connecting portion 47 acts as a flexible structure portion relatively freely and elastically deformable when the tractor runs with the backhoe 3 attached or during an excavating operation with the backhoe 3. The elastic deformation of the frame portion 53 absorbs the overloads occurring when the tractor runs with the backhoe 3 attached or during an excavating operation with the backhoe 3, thereby suppressing transmission of the overloads to the rear axle unit 9. The rear axle unit 9 and the like must be reinforced substantially if such overloads were transmitted as they are to these components. The invention avoids an enlargement and increased manufacturing cost of the rear axle unit 9 due to such reinforcement.

As shown in FIGS. 1 and 3, the transmission case 17 has a gear pump 54 projecting from a rear end thereof to be opposed to the backhoe 3 through a space 55 in the reinforcing frame unit 43 for feeding pressure oil toward the backhoe 3. Thus, piping or the like not shown may be passed through the space 55 in the reinforcing frame unit 43 to extend from the gear pump 54 to the backhoe 3. A piping operation may be carried out with ease to link the tractor 1 and backhoe 3. At the same time, the reinforcing frame unit 43 effectively prevents foreign objects from contacting the piping and the like extending between the gear pump 54 and backhoe 3.

Modified embodiments of this invention will be described hereinafter.

First Modified Embodiment

Figure 4:
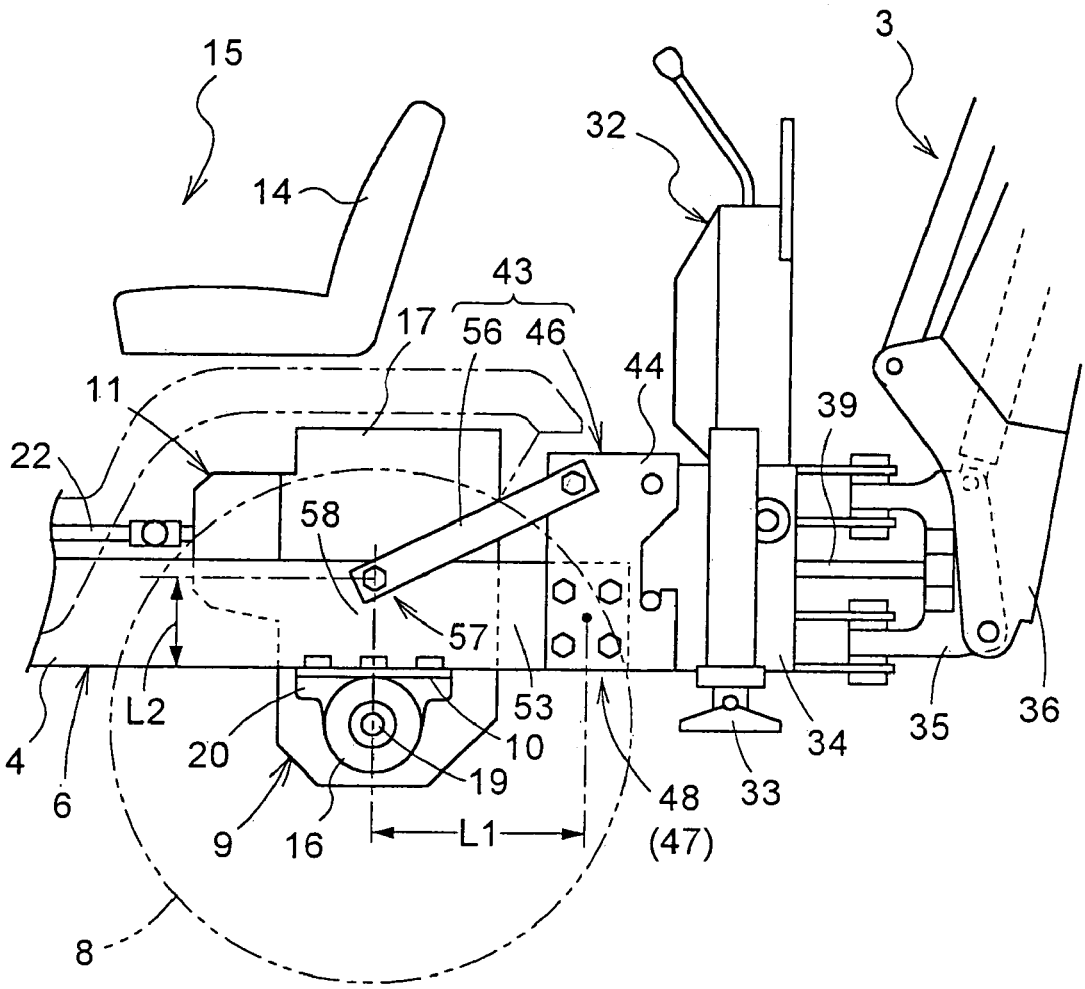
FIG. 4 is a plan view of a principal portion showing a reinforcing structure in a first modified embodiment.

As shown in FIG. 4, the first modified embodiment includes a pair of right and left brace members 56 provided for the reinforcing frame unit 43 shown in the foregoing embodiment. Each brace member 56 is connected at one end thereof to an upper forward position of the corresponding side member 44, and at the other end to a position of the corresponding elongate frame member 4 vertically spaced by a distance L2 from the connecting bracket 10.

With this construction, the gate-shaped frame 46 to which the backhoe 3 is attached has increased supporting strength. Loads acting on the gate-shaped frame 46 are distributed to the right and left elongate frame members 4 and the right and left brace members 56. Further, a vertical frame portion 58 of each of the right and left elongate frame members 4 between a connection 57 to the brace member 56 and the connecting bracket 10, as well as the horizontal frame portion 53 of each elongate frame member 4 between the connecting bracket 10 and the reinforcing frame connecting portion 47, acts as a flexible structure portion relatively freely and elastically deformable. The elastic deformation of the frame portions 53 of the light and left elongate frame members 4 between the connecting bracket 10 and the reinforcing frame connecting portion 47 absorbs components distributed to the right and left elongate frame members 4 of the overloads occurring when the tractor runs with the backhoe 3 attached or during an excavating operation with the backhoe 3, thereby suppressing transmission of the overload components to the rear axle unit 9. The elastic deformation of the frame portions 58 of the right and left elongate frame members 4 between the connections 57 to the brace members 56 and the connecting bracket 10 absorbs load components distributed to the right and left brace members 56, thereby suppressing transmission of the overload components to the rear axle unit 9. As a result, an enlargement and increased manufacturing cost of the rear axle unit 9 may be effectively avoided. Such drawbacks could be encountered where the rear axle unit 9 and the like must be reinforced substantially if such overloads were transmitted as they are to these components. In addition, the backhoe 3 may be attached to the tractor 1 with increased stability.

Second Modified Embodiment

Figure 5:
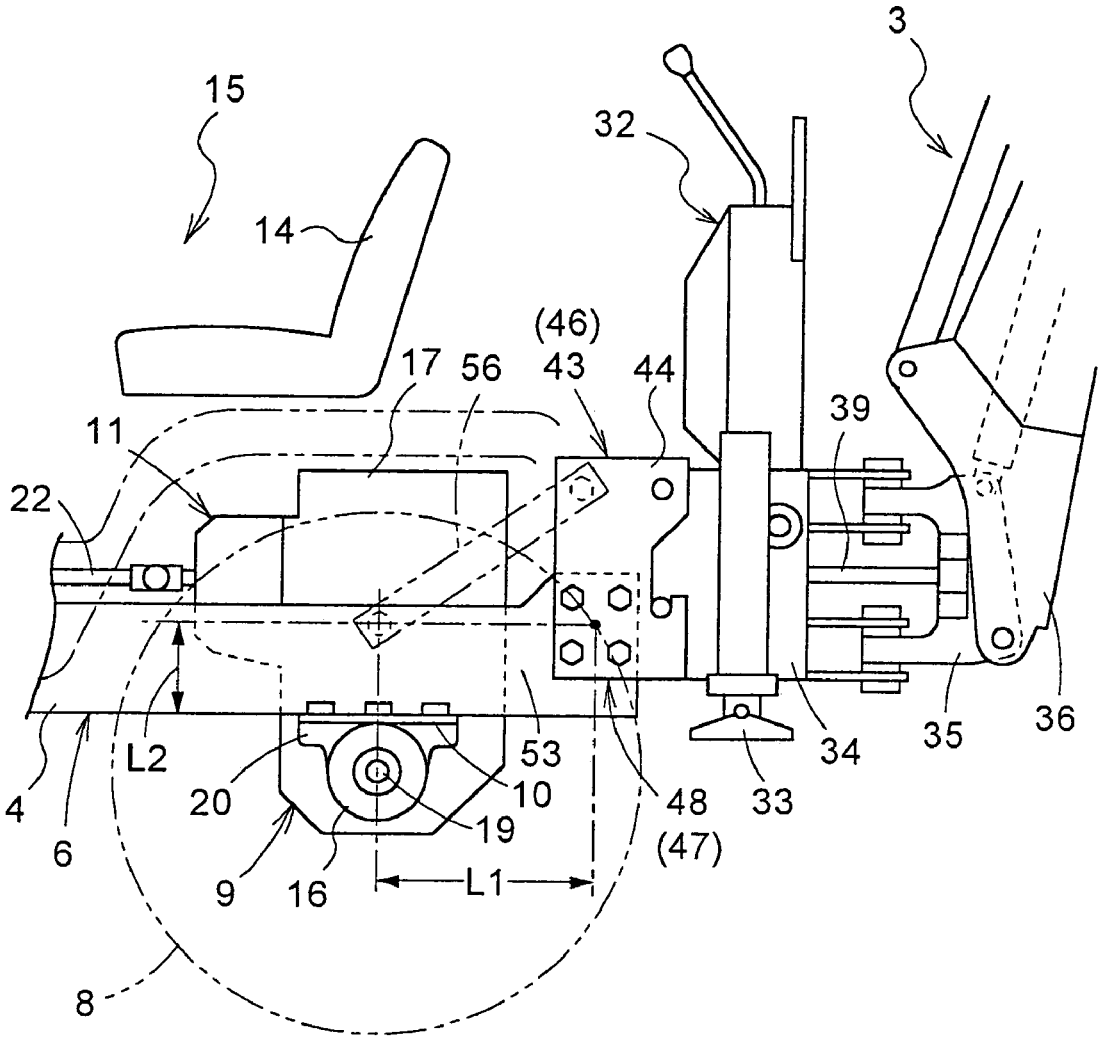
FIG. 5 is a plan view of a principal portion showing a reinforcing structure in a second modified embodiment.

In the second modified embodiment, as shown in FIG. 5, each of the right and left elongate frame members 4 has a reinforcing frame connecting portion 47 formed in an upper portion of a rear end region thereof horizontally spaced by the distance L1 from the connecting bracket 10 and vertically by the distance L2 from the connecting bracket 10. The reinforcing frame unit 43 shown in the foregoing embodiments has the reinforcing frame connecting portion 48 formed in the lower end region of each side member 44 and connected to the reinforcing frame connecting portion 47 formed in the upper portion.

With this construction, the horizontal frame portion 53 extending over the horizontal distance L1 and vertical distance L2 between the connecting bracket 10 and reinforcing frame connecting portion 47 of each of the right and left elongate frame members 4 acts as a flexible structure portion relatively freely and elastically deformable when the tractor runs with the backhoe 3 attached or during an excavating operation with the backhoe 3. The elastic deformation of the frame portion 53 absorbs the overloads occurring when the tractor runs with the backhoe 3 attached or during an excavating operation with the backhoe 3, thereby suppressing transmission of the overloads to the rear axle unit 9. As a result, an enlargement and increased manufacturing cost of the rear axle unit 9 may be effectively avoided. Such drawbacks could be encountered where the rear axle unit 9 and the like must be reinforced substantially if such overloads were transmitted as they are to these components.

In this construction also, as shown in a two-dot chain line in FIG. 5, the reinforcing frame unit 43 may have the pair of right and left brace members 56 shown in the first modified embodiment.

Third Modified Embodiment

Figure 6:
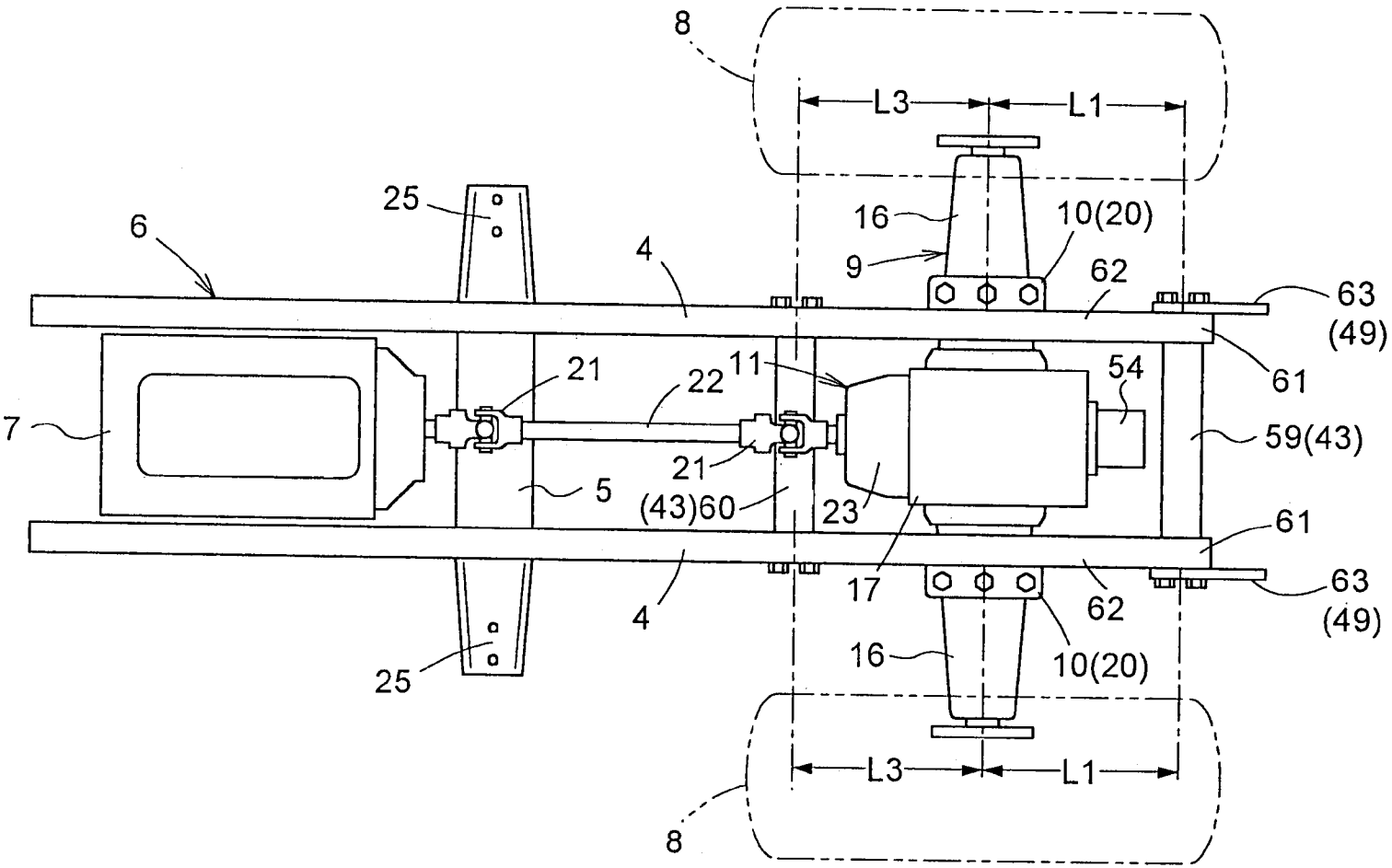
FIG. 6 is a plan view of a principal portion showing a reinforcing structure in a third modified embodiment.

In the third modified embodiment, as shown in FIG. 6, a reinforcing frame unit 43 includes a cross frame 59 extending transversely of the vehicle body and interconnecting the rear end regions of the right and left elongate frame members 4 horizontally spaced by the distance L1 from the connecting brackets 10 acting as rear axle connectors, and a cross frame 60 extending transversely of the vehicle body and interconnecting rear end regions of the right and left elongate frame members 4 horizontally spaced by a distance L3 from the connecting brackets 10.

With this construction, the two cross frames 59 and 60 extending between the right and left elongate frame members 4 reinforce the rear region of vehicle frame 6 to which the backhoe 3 is attached. A horizontal frame portion 62 between the connecting bracket 10 and a connecting position 61, to which the rear cross frame 59 is connected, of each of the right and left elongate frame members 4 acts as a flexible structure portion relatively freely and elastically deformable. The elastic deformation of the frame portion 62 absorbs the overloads occurring when the tractor runs with the backhoe 3 attached or during an excavating operation with the backhoe 3, thereby suppressing transmission of the overloads to the rear axle unit 9. As a result, an enlargement and increased manufacturing cost of the rear axle unit 9 may be effectively avoided. Such drawbacks could be encountered where the rear axle unit 9 and the like must be reinforced substantially if such overloads were transmitted as they are to these components.

The cross frame 60 may be formed of sheet metal, steel pipe or other material.

Numeral 63 in FIG. 6 denotes a pair of right and left backhoe attaching brackets erected at the rear ends of right and left elongate frame members 4 and having backhoe attaching portions 49.

Though not shown, the reinforcing frame unit 43 may include only the single cross frame 59 extending transversely of the vehicle body and interconnecting the rear end regions of the right and left elongate frame members 4 horizontally spaced by the distance L1 from the connecting brackets 10 acting as rear axle connectors, or may include this cross frame 59 and the gate-shaped frame 46, shown in the foregoing embodiments, which interconnects the rear end regions of the right and left elongate frame members 4 horizontally spaced by the distance L1 from the connecting brackets 10 acting as rear axle connectors. Furthermore, the pair of right and left brace members 56 shown in the first modified embodiment may be provided to extend from the gate-shaped frame 46 to the right and left elongate frame members 4.

Fourth Modified Embodiment

Figure 7:
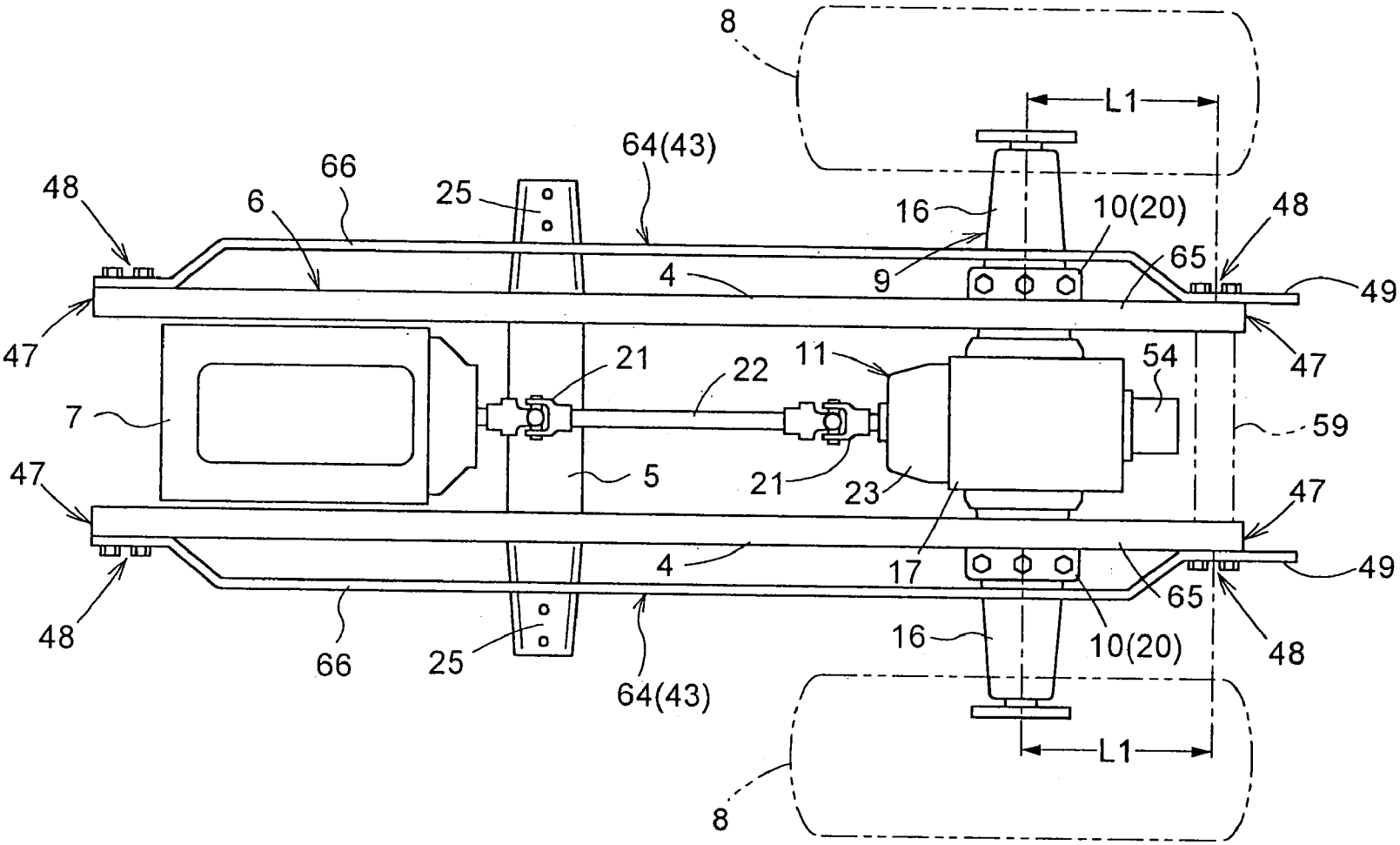
FIG. 7 is a plan view of a principal portion showing a reinforcing structure in a fourth modified embodiment.

In the fourth modified embodiment, as shown in FIG. 7, a reinforcing frame unit 43 includes a pair of right and left band-like elongate reinforcing frames 64 extending along outer faces of the right and left elongate frame members 4, respectively. Each reinforcing frame 64 has a rear end region thereof defining a reinforcing frame connecting portion 48 connected to a reinforcing frame connecting portion 47 formed in the rear end region of the corresponding, elongate frame member 4 horizontally spaced by the distance L1 from the connecting bracket 10 acting as the rear axle connector, and a forward end region defining a reinforcing frame connecting portion 48 connected to a reinforcing frame connecting portion 47 formed in a forward end region of the corresponding elongate frame member 4 beyond where the engine 7 is mounted.

With this construction, the overloads occurring when the tractor runs with the backhoe 3 attached or during an excavating operation with the backhoe 3 are distributed to the right and left elongate frame members 4 and right and left reinforcing frames 64. A frame portion 65 between the connecting bracket 10 and the reinforcing frame connecting portion 47 in the rear end region of each of the light and left elongate frame members 4, and a frame portion 66 between the front and rear reinforcing frame connecting portions 48 of each of the right and left reinforcing frames 64, act as flexible structure portions relatively freely and elastically deformable. The elastic deformation of the frame portions 65 between the connecting brackets 10 and the reinforcing frame connecting portions 47 in the rear end regions of the right and left elongate frame members 4 absorbs components distributed to the right and left elongate frame members 4 of the overloads occurring when the tractor runs with the backhoe 3 attached or during an excavating operation with the backhoe 3, thereby suppressing transmission of the overload components to the rear axle unit 9. The elastic deformation of the frame portions 66 between the front and rear reinforcing frame connecting portions 48 of the right and left reinforcing frames 64 absorbs load components distributed to the right and left reinforcing frames 64 and transmits the load components to the forward end regions of the elongate frame members 4, thereby avoiding transmission thereof to the rear axle unit 9. As a result, an enlargement and increased manufacturing cost of the rear axle unit 9 may be effectively avoided. Such drawbacks could be encountered where the rear axle unit 9 and the like must be reinforced substantially if such overloads were transmitted as they are to these components.

In this construction, the right and left reinforcing frames 64 have backhoe attaching portions 49 at the rear ends thereof, respectively.

As shown in two-dot chain lines in FIG. 7, the cross frame 59 extending transversely of the vehicle body, shown in the third modified embodiment, may be connected to the reinforcing frame connecting portions 47 in the rear end regions of the right and left elongate frame members 4, along with the reinforcing frame connecting portions 48 in the rear end regions of the right and left reinforcing frames 64. Though not shown, the gate-shaped frame 46 in the foregoing embodiments may be provided instead of the cross frame 59. This gate-shaped frame 46 may have backhoe attaching portions 49. Further, a pair of right and left brace members as shown in the first modified embodiment may be provided to extend from the gate-shaped frame 46 to the right and left elongate frame members 4 or right and left reinforcing frames 64.

Fifth Modified Embodiment

Figure 8:
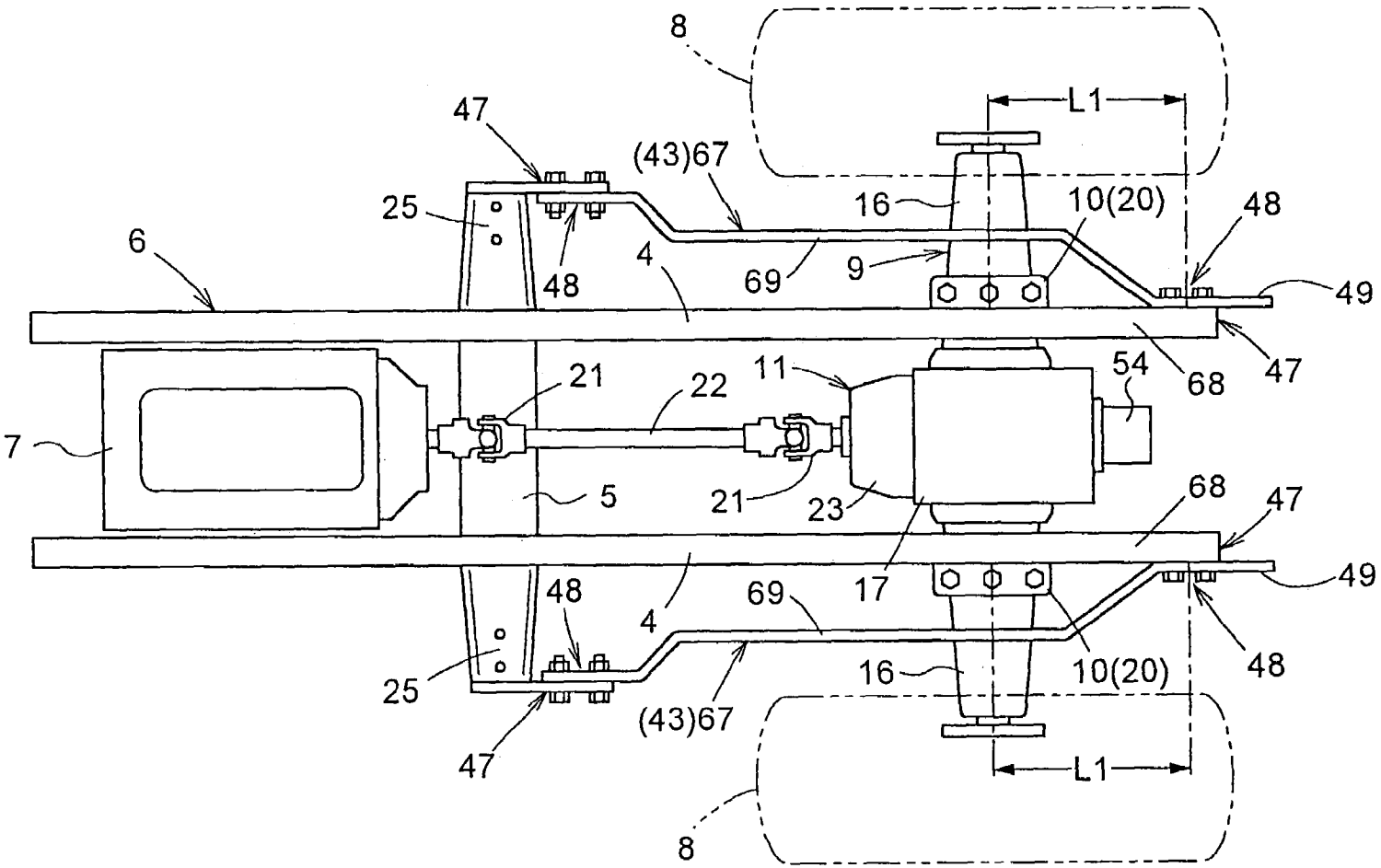
FIG. 8 is a plan view of a principal portion showing a reinforcing structure in a fifth modified embodiment.

In the fifth modified embodiment, as shown in FIG. 8, a reinforcing frame unit 43 includes a pair of right and, left band-like elongate reinforcing frames 67 extending along outer faces of the right and left elongate frame members 4, respectively. Each reinforcing frame 67 has a rear end region thereof defining a reinforcing frame connecting portion 48 connected to a reinforcing frame connecting portion 47 formed in the rear end region of the corresponding elongate frame member 4 horizontally spaced by the distance L1 from the connecting bracket 10 acting as the rear axle connector, and a forward end region defining a reinforcing frame connecting portion 48 connected to a reinforcing frame connecting portion 47 formed in one of the front loader post support members 25 projecting from a longitudinally intermediate portion of the corresponding elongate frame member 4.

With this construction, the overloads occurring when the tractor runs with the backhoe 3 attached or during an excavating operation with the backhoe 3 are distributed to the right and left elongate frame members 4 and right and left reinforcing frames 67. A frame portion 68 between the connecting bracket 10 and the reinforcing frame connecting portion 47 in the rear end region of each of the right and left elongate frame members 4, and a frame portion 69 between the front and rear reinforcing frame connecting portions 48 of each of the right and left reinforcing frames 67, act as flexible structure portions relatively freely and elastically deformable. The elastic deformation of the frame portions 68 between the connecting brackets 10 and the reinforcing frame connecting portions 47 in the rear end regions of the right and left elongate frame members 4 absorbs components distributed to the right and left elongate frame members 4 of the overloads occurring when the tractor runs with the backhoe 3 attached or during an excavating operation with the backhoe 3, thereby suppressing transmission of the overload components to the rear axle unit 9. The elastic deformation of the frame portions 69 between the front and rear reinforcing frame connecting portions 48 of the right and left reinforcing frames 67 absorbs load components distributed to the right and left reinforcing frames 67 and transmits the load components to the front loader post support members 25, thereby avoiding transmission thereof to the rear axle unit 9. As a result, an enlargement and increased manufacturing cost of the rear axle unit 9 may be effectively avoided. Such drawbacks could be encountered where the rear axle unit 9 and the like must be reinforced substantially if such overloads were transmitted as they are to these components.

In this construction, the right and left reinforcing frames 67 have backhoe attaching portions 49 at the rear ends thereof, respectively.

Though not shown, the cross frame 59 extending transversely of the vehicle body, shown in the third modified embodiment, may be connected to the reinforcing frame connecting portions 47 in the rear end regions of the right and left elongate frame members 4, along with the reinforcing frame connecting portions 48 in the rear end regions of the right and left reinforcing frames 67. The gate-shaped frame 46 in the foregoing embodiments may be provided instead of the cross frame 59. This gate-shaped frame 46 may have backhoe attaching portions 49. Further, a pair of right and left brace members as shown in the first modified embodiment may be provided to extend from the gate-shaped frame 46 to the right and left elongate frame members 4 or right and left reinforcing frames 67.

Sixth Modified Embodiment

Figure 9:
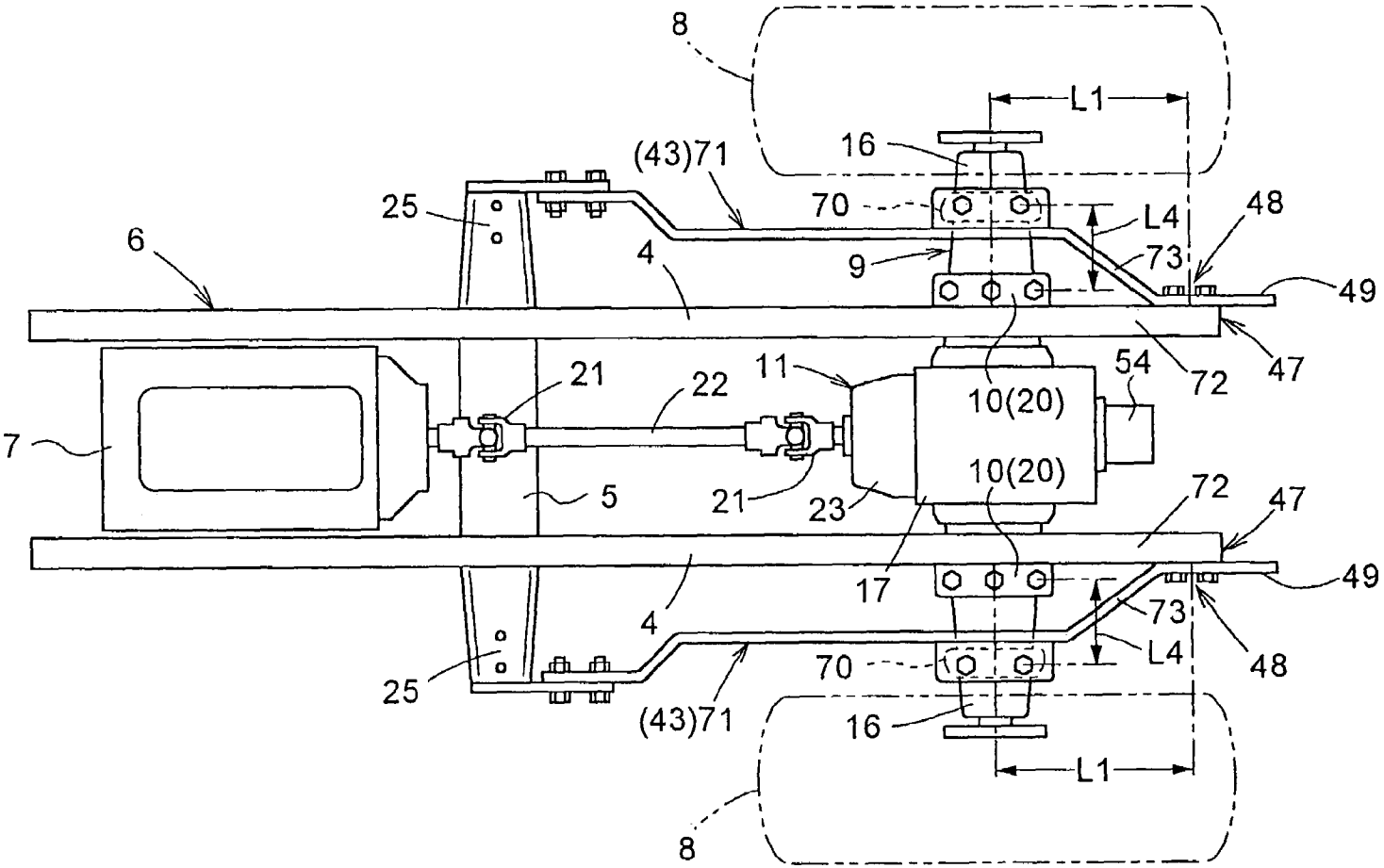
FIG. 9 is a plan view of a principal portion showing a reinforcing structure in a sixth modified embodiment.

In the sixth modified embodiment, as shown in FIG. 9, a reinforcing frame unit 43 includes a pair of right and left band-like elongate reinforcing frames 71 extending along outer faces of the right and left elongate frame members 4, respectively. Each reinforcing frame 71 has a rear end region thereof defining a reinforcing frame connecting portion 48 connected to a reinforcing frame connecting portion 47 formed in the rear end region of the corresponding elongate frame member 4 horizontally spaced by the distance L1 from the connecting bracket 10 acting as the rear axle connector, a longitudinally intermediate portion connected to another connector 70 formed on one of the right and left rear axle cases 16 and laterally outwardly spaced by a distance L4 from the connector 20 to which the connecting bracket 10 is connected, and a forward end region connected to one of the front loader post support members 25 projecting from a longitudinally intermediate portion of the corresponding elongate frame member 4.

With this construction, the overloads occurring when the tractor runs with the backhoe 3 attached or during an excavating operation with the backhoe 3 are distributed to the right and left elongate frame members 4 and right and left reinforcing frames 71. A frame portion 72 between the connecting bracket 10 and the reinforcing frame connecting portion 47 of each of the right and left elongate frame members 4, and a frame portion 73 between the connector 70 formed on one of the rear axle cases 16 and the rear reinforcing frame connecting portion 48 of each of the right and left reinforcing frames 71, act as flexible structure portions relatively freely and elastically deformable. The elastic deformation of the frame portions 72 between the connecting brackets 10 and the reinforcing frame connecting portions 47 of the light and left elongate frame members 4 absorbs components distributed to the right and left elongate frame members 4 of the overloads occurring when the tractor runs with the backhoe 3 attached or during an excavating operation with the backhoe 3, thereby suppressing transmission of the overload components to the rear axle unit 9. The elastic deformation of the frame portions 73 between the connectors 70 formed on the rear axle cases 16 and the rear reinforcing frame connecting portions 48 in the rear end regions of the right and left reinforcing frames 71, absorbs load components distributed to the right and left reinforcing frames 71, thereby suppressing transmission thereof to the rear axle unit 9. As a result, an enlargement and increased manufacturing cost of the rear axle unit 9 may be effectively avoided. Such drawbacks could be encountered where the rear axle unit 9 and the like must be reinforced substantially if such overloads were transmitted as they are to these components.

In this construction, the right and left reinforcing frames 71 have backhoe attaching portions 49 at the rear ends thereof, respectively.

Though not shown, the cross frame 59 extending transversely of the vehicle body, shown in the third modified embodiment, may be connected to the reinforcing frame connecting portions 47 in the rear end regions of the right and left elongate frame members 4, along with the reinforcing frame connecting portions 48 in the rear end regions of the right and left reinforcing frames 71. The gate-shaped frame 46 in the foregoing embodiments may be provided instead of the cross frame 59. This gate-shaped frame 46 may have backhoe attaching portions 49. Further, a pair of right and left brace members as shown in the first modified embodiment may be provided to extend from the gate-shaped frame 46 to the right and left elongate frame members 4 or right and left reinforcing frames 71.

Further, though not shown, short right and left reinforcing frames 71 may be employed, each of such frames 71 extending the reinforcing frame connecting portion 47 of each elongated frame member 4 to the connector 70 on one of the rear axle cases 16.

Seventh Modified Embodiment

Figure 10:
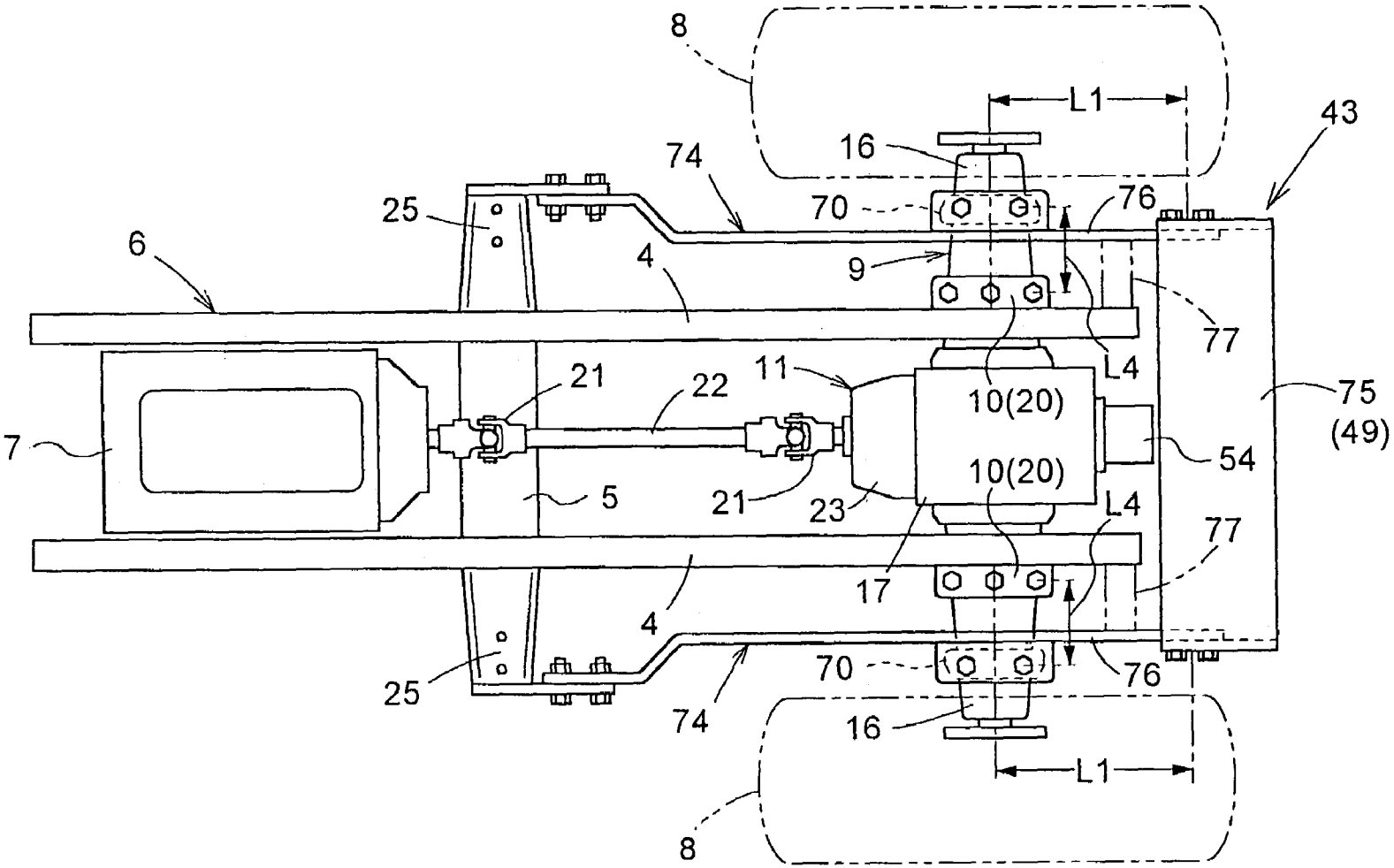
FIG. 10 is a plan view of a principal portion showing a reinforcing structure in a seventh modified embodiment.

In the seventh modified embodiment, as shown in FIG. 10, a reinforcing frame unit 43 includes a pair of right and left band-like elongate reinforcing frames 74 extending along outer faces of the right and left elongate frame members 4, respectively. Each reinforcing frame 74 has a forward end region connected to one of the front loader post support members 25 projecting from a longitudinally intermediate portion of the corresponding elongate frame member 4, and a longitudinally intermediate portion connected to another connector 70 formed on one of the right and left rear axle cases 16 and laterally outwardly spaced by a distance L4 from the connector 20 to which the connecting bracket 10 is connected. The, reinforcing frame unit 43 includes also a gate-shaped frame 75 interconnecting rear end regions of the right and left reinforcing frames 74 horizontally spaced by the distance L1 from the connectors on the rear axles cases 16. The gate-shaped frame 75 has backhoe attaching portions 48.

With this construction, the horizontal frame portion 76 extending over the horizontal distance L1 between the gate-shaped frame 75 and the connecting bracket 10 of each of the right and left reinforcing frames 74 acts as a flexible structure portion relatively freely and elastically deformable when the tractor runs with the backhoe 3 attached or during an excavating operation with the backhoe 3. The elastic deformation of the frame portions 76 absorbs the overloads occurring when the tractor runs with the backhoe 3 attached or during an excavating operation with the backhoe 3, thereby suppressing transmission of the overload components to the rear axle unit 9. As a result, an enlargement and increased manufacturing cost of the rear axle unit 9 may be effectively avoided. Such drawbacks could be encountered where the rear axle unit 9 and the like must be reinforced substantially if such overloads were transmitted as they are to these components.

In this construction, as shown in two-dot chain lines in FIG. 10, the reinforcing frame unit 43 may include a pair of right and left cross frames 77 extending transversely and each interconnecting rear end regions of one of the right and left elongate frame members 4 and the corresponding reinforcing frame 74. Though not shown, the cross frame 59 extending transversely of the vehicle body, shown in the third modified embodiment may be provided to interconnect the rear end regions of the right and left elongate frame members 4. Further, a pair of right and left brace members as shown in the first modified embodiment may be provided to extend from the gate-shaped frame 75 to the right and left elongate frame members 4 or right and left reinforcing frames 74.

The invention claimed is:

1. A tractor having a vehicle frame with a pair of right and left elongate frame members spaced from each other and extending in a longitudinal direction and interconnected in intermediate positions by a cross member, an engine supported by the elongate frame members in a front region of the vehicle frame, a rear axle unit connected to rear axle connecting members fixed to the elongate frame members in a rear region of the vehicle frame, and a drive transmitting mechanism for transmitting drive from the engine to the rear axle unit, a front loader and a backhoe attachable to a front and a rear of the tractor, respectively, as supported by the vehicle frame, said tractor comprising:

a reinforcing frame unit for reinforcing said vehicle frame; and reinforcing frame connecting portions connecting said reinforcing frame unit to said vehicle frame;

wherein:

said reinforcing frame unit includes elongate reinforcing frames extending along outer faces of said elongate frame members, respectively;

said elongate frame members have front loader post support members projecting laterally outwardly of longitudinally intermediate portions thereof; and one of said reinforcing frame connecting portions is formed at a direct connection between a rear end region of each of said reinforcing frames and a rear end region of each of said elongate frame members such that the direct connection between the rear end region of each of said reinforcing frames and a rear end region of each of said elongate frame members lies rearward from said rear axle connecting members, and another of said reinforcing frame connecting portions is formed at a connection between a forward end region of each of said reinforcing frames and each of said front loader post support members.

2. A tractor having a vehicle frame with a pair of right and left elongate frame members spaced from each other and extending in a longitudinal direction and interconnected in intermediate positions by a cross member, an engine supported by the elongate frame members in a front region of the vehicle frame, a rear axle unit connected to rear axle connecting members fixed to the elongate frame members in a rear region of the vehicle frame, and a drive transmitting mechanism for transmitting drive from the engine to the rear axle unit, a backhoe attachable to a rear of the tractor as supported by the vehicle frame, said tractor comprising:

a reinforcing frame unit for reinforcing said vehicle frame; and reinforcing frame connecting portions connecting said reinforcing frame unit to said vehicle frame;

wherein:

said reinforcing frame unit includes reinforcing frames extending along outer faces of said elongate frame members, respectively;

said reinforcing frame connecting portions are formed at a direct connection between a rear end region of each of said reinforcing frames and a rear end region of each of said elongate frame members such that the direct connection between the rear end region of each of said reinforcing frames and the rear end region of each of said elongate frame members lies rearward from said rear axle connecting members; and said reinforcing frames are connected to said rear axle unit in positions spaced outwardly from said rear axle connecting members.

3. A tractor as defined in claim 2, wherein a front loader is attachable to a front of the tractor as supported by the vehicle frame;

said elongate frame members have front loader post support members projecting laterally outwardly of longitudinally intermediate portions thereof, and another of said reinforcing frame connecting portions is formed at a connection between a forward end region of each of said reinforcing frames and each of said front loader post support members; and said reinforcing frames are connected to said rear axle unit in longitudinally intermediate positions thereof.

* * * * *